US011276934B2

(12) United States Patent
Leung et al.

(10) Patent No.: US 11,276,934 B2
(45) Date of Patent: Mar. 15, 2022

(54) ANTENNA

(71) Applicant: City University of Hong Kong, Kowloon (HK)

(72) Inventors: Kwok Wa Leung, Kowloon Tong (HK); Lei Guo, Kowloon Tong (HK); Nan Yang, Kowloon Tong (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/002,261

(22) Filed: Jun. 7, 2018

(65) Prior Publication Data

US 2019/0379123 A1 Dec. 12, 2019

(51) Int. Cl.

| | |
|---|---|
| ***H01Q 9/34*** | (2006.01) |
| ***H01Q 9/04*** | (2006.01) |
| ***H01Q 1/22*** | (2006.01) |
| ***H01Q 21/00*** | (2006.01) |
| ***H01Q 13/10*** | (2006.01) |
| ***H01Q 1/48*** | (2006.01) |

(52) U.S. Cl.

CPC ..... *H01Q 9/0485* (2013.01); *H01Q 1/22* (2013.01); *H01Q 1/48* (2013.01); *H01Q 13/10* (2013.01); *H01Q 21/0068* (2013.01)

(58) Field of Classification Search

CPC ..... H01Q 11/105; H01Q 13/02; H01Q 13/06; H01Q 13/04; H01Q 3/2664; H01Q 3/28; H01Q 13/24; H01Q 9/30; H01Q 9/38

USPC ..... 343/731–737, 772–786, 825–831

See application file for complete search history.

(56) References Cited

U.S. PATENT DOCUMENTS

| | | | | |
|---|---|---|---|---|
| 3,710,340 | A | 1/1973 | Mayes et al. | |
| 3,868,694 | A | 2/1975 | Meinke | |
| 4,972,196 | A | 11/1990 | Mayes et al. | |
| 7,589,686 | B2 | 9/2009 | Balzovsky et al. | |
| 7,843,389 | B2 | 11/2010 | Luk et al. | |
| 2005/0017903 | A1* | 1/2005 | Ittipiboon | H01Q 9/0485 343/700 MS |
| 2010/0103061 | A1 | 4/2010 | Yung et al. | |
| 2018/0115072 | A1* | 4/2018 | Pance | H01Q 9/0485 |

OTHER PUBLICATIONS

L. Guo, K. W. Leung, and Y. M. Pan, "Compact unidirectional ring dielectric resonator antennas with lateral radiation," IEEE Trans. Antennas Propag. , vol. 63 , No. 12, pp. 5334-5342, Dec. 2015.

* cited by examiner

*Primary Examiner* — Binh B Tran

(74) *Attorney, Agent, or Firm* — Renner Kenner Greive Bobak Taylor & Weber

(57) ABSTRACT

An antenna and an antenna array, the antenna including a dielectric resonator fed by a feeder connected to a ground plane, wherein the dielectric resonator is arranged to emit an electromagnetic radiation along a wave propagation axis upon an electric excitation input to the feeder, and wherein the electromagnetic radiation is equivalent to a combination of a plurality of electromagnetic wave components.

18 Claims, 11 Drawing Sheets

ANTENNA

TECHNICAL FIELD

The present invention relates to an antenna, and particularly, although not exclusively, to a unilateral antenna.

BACKGROUND

Unidirectional antenna may be used in wireless communication due to its capability of confining or concentrating radiation in a desired direction. Conventionally, complementary antenna has been used to obtain a unidirectional radiation pattern.

A unidirectional radiation pattern can be broadly classified into two types: broadside radiation and lateral radiation. For broadside radiation, magneto-electric dipoles have been used in various applications including wideband, low-profile, diversity, dual-band, circular-polarization, and reconfiguration applications. On the other hand, for unilateral radiation, structures with cavity-backed slot-monopole configurations have been used.

In some applications, lateral radiation may be more preferred than the broadside radiation. For example, for a household wireless router that is arranged to be placed against a wall, a unilateral radiation pattern is more preferred because back radiation inside the wall, if any, would go wasted. However, existing structures for unilateral radiation may require the use of cavities and relatively large ground planes, and hence are rather bulky.

There is a need for a unidirectional antenna, in particular one that generates unilateral radiation pattern, that is compact, easy to manufacture, and operationally efficient, to be adapted for use in modern wireless communication systems.

SUMMARY OF THE INVENTION

In accordance with a first aspect of the present invention, there is provided an antenna comprising a dielectric resonator fed by a feeder connected to a ground plane, wherein the dielectric resonator is arranged to emit an electromagnetic radiation along a wave propagation axis upon an electric excitation input to the feeder, and wherein the electromagnetic radiation is equivalent to a combination of a plurality of electromagnetic wave components.

In an embodiment of the first aspect, the electromagnetic radiation is unilateral along the wave propagation axis.

In an embodiment of the first aspect, the plurality of electromagnetic wave components include a first electromagnetic wave component and a second electromagnetic wave component, wherein the first and the second electromagnetic wave components are respectively arranged in a first and a second direction, and each of the first and the second direction is orthogonal to the wave propagation axis.

In an embodiment of the first aspect, the first direction, the second direction and the wave propagation axis are mutually orthogonal to each other.

In an embodiment of the first aspect, the first electromagnetic wave component is arranged to produce a broadside radiation pattern in the first direction.

In an embodiment of the first aspect, the second electromagnetic wave component is arranged to produce a quasi-omnidirectional radiation patterns in a second direction.

In an embodiment of the first aspect, the first and the second electromagnetic wave components combine and form a complementary field pattern equivalent to a field pattern of the electromagnetic radiation.

In an embodiment of the first aspect, the first electromagnetic wave component includes an O-shape field pattern and an ∞-shape field pattern in a yz-plane and a xy-plane respectively, and wherein the wave propagation axis is defined along a y-axis of a three-dimensional space.

In an embodiment of the first aspect, the second electromagnetic wave component includes an ∞-shape field pattern and an elliptical-shape field pattern in a yz-plane and a xy-plane respectively.

In an embodiment of the first aspect, the second electromagnetic wave component includes a stronger $H_y$ component than a $H_x$ component in the xy-plane.

In an embodiment of the first aspect, the first electromagnetic wave component is exited in a dielectric resonator $TE_{\delta 11}{}^{x}$ mode.

In an embodiment of the first aspect, the second electromagnetic wave component is exited in a dielectric resonator $TE_{2\delta 1}{}^{y}$ mode.

In an embodiment of the first aspect, the feeder includes a probe feeder.

In an embodiment of the first aspect, the probe feeder is positioned shifted from a center position of the dielectric resonator.

In an embodiment of the first aspect, the probe feeder is positioned through the ground plane and is disposed within a hole in the dielectric resonator.

In an embodiment of the first aspect, the ground plane includes a dimension substantially equal to a planar surface of the dielectric resonator.

In an embodiment of the first aspect, the ground plane is positioned adjacent to the planar surface.

In an embodiment of the first aspect, the planar surface is substantially rectangular in shape.

In an embodiment of the first aspect, the dielectric resonator is a rectangular block of dielectric material.

In accordance with a second aspect of the present invention, there is provided an antenna array comprising a plurality of antennas in accordance with the first aspect.

In an embodiment of the second aspect, each of the wave propagation axes of the respective antennas includes an orientation different from each other.

In an embodiment of the second aspect, at least two of the wave propagation axes of the respective antennas are oriented in parallel.

BRIEF DESCRIPTION OF THE DRAWINGS

Embodiments of the present invention will now be described, by way of example, with reference to the accompanying drawings in which.

DETAILED DESCRIPTION

The inventors have, through their own research, trials and experiments, devised that, dielectric resonator antenna (DRA) has the advantageous features of compact size, low loss, and ease of excitation. In addition, by using a different DRA mode, a broadside or omnidirectional radiation pattern can be obtained. A multi-function or diversity DRA can also be obtained by making use of different DRA modes simultaneously.

In some examples, DRAs may be excited in either a boresight or omnidirectional mode. Sometimes, however, a unilateral radiation mode is preferred. For example, when an antenna is placed beside a wall (e.g., WiFi rounter), it is desired that the antenna will radiate unilaterally, with no energy radiated into the wall.

In one example embodiment, a unilateral DRA may be obtained by placing a reflector/cavity beside an omnidirectional DRA to concentrate the radiation in the desired direction. However, the introduced reflector/cavity will complicate the design and increase the antenna size. Alternatively, another complementary antenna design may be applied, such design may have several attractive advantages, such as a high front-to-back ratio (FTBR), considerable beamwidth, and stable radiation pattern. Based on the complementary antenna concept, several example unilateral designs may involve deployments of slots and monopoles.

Such concept has also been applied to another example embodiment. A microstrip patch antenna and a coupling capacitor may be used to obtain a compact unilateral design, at the cost of having a relatively low efficiency of less than 35%. Some of these unidirectional patch antenna design, it may radiate in the boresight direction, however not in the lateral direction.

In another example unilateral DRA design using the complementary antenna concept, comparing with the previous complementary slot/monopole designs, such unilateral DRA may be more compact as the ground plane may nearly of the same size as the footprint of the DRA. A wideband version that triples the operating frequency bandwidth is also possible.

Alternatively, the compact unilateral DRA may be built with a simplified feed network. All these DRAs deploy a monopole to provide an omnidirectional radiation pattern for obtaining a unidirectional radiation pattern.

In accordance with an example embodiment of the present invention, there is provided a method of using a higher-order mode of a DRA to obtain the required omnidirectional radiation pattern. Preferably, the fundamental mode may be excited to obtain the required equivalent magnetic current. The antenna may be deployed with a single off-center probe. This feeding method may also be used in a probe-fed DRA design, however it generates the unilateral radiation rather than the broadside one in the DRA. Preferably, the probe may be used for exciting both the fundamental and higher-order modes, not for generating the omnidirectional pattern.

Figure 1:
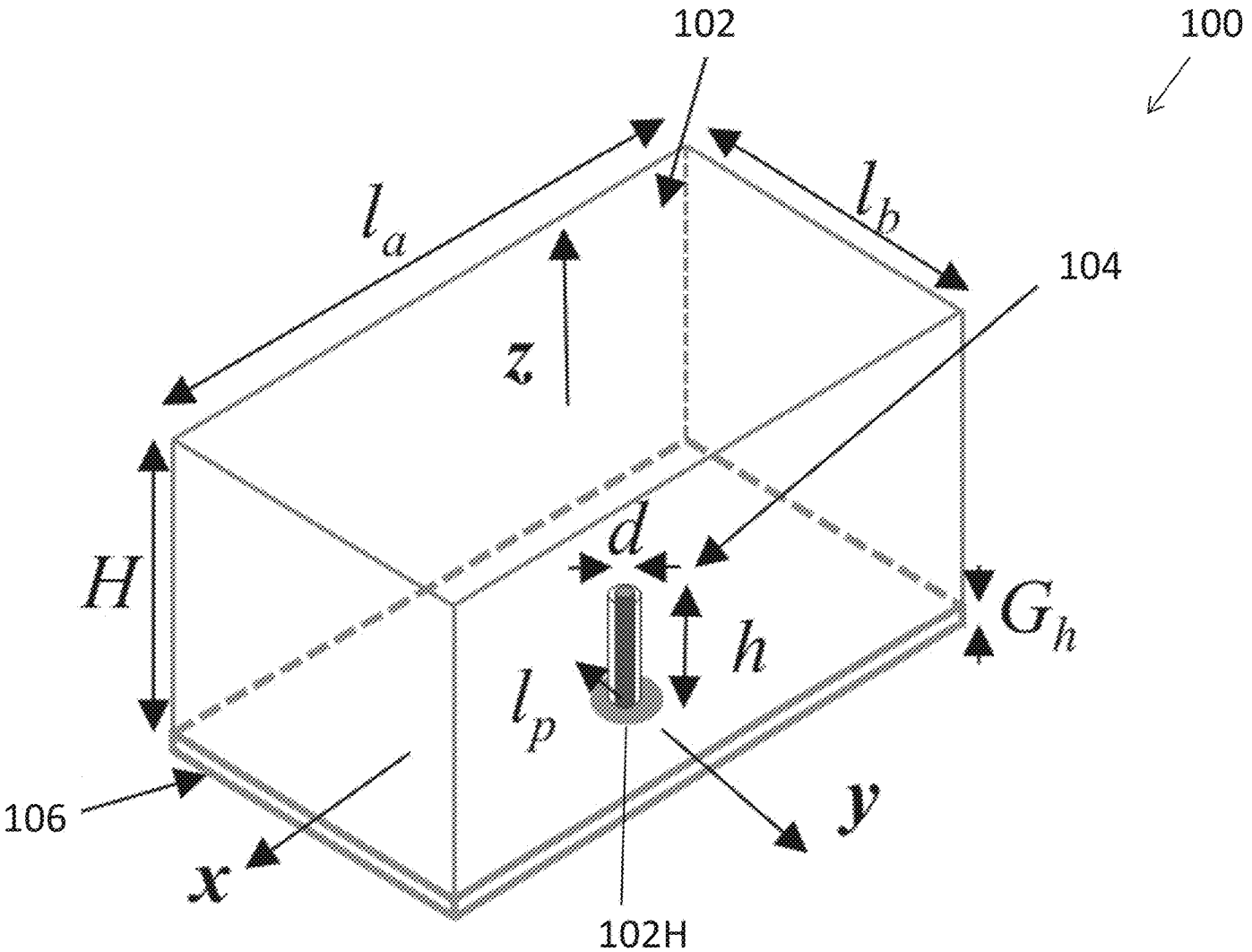
FIG. 1 is a perspective view of an antenna in accordance with one embodiment of the present invention.

With reference to FIG. 1, there is shown an embodiment of an antenna 100 comprising a dielectric resonator (DRA) 102 fed by a feeder 104 connected to a ground plane 106, wherein the dielectric resonator 102 is arranged to emit a electromagnetic (EM) radiation along a wave propagation axis upon an electric excitation input to the feeder 104, and wherein the electromagnetic radiation is equivalent to a combination of a plurality of electromagnetic wave components.

In this embodiment, the antenna 100 may be used as a probe-fed unilateral rectangular dielectric resonator antenna (DRA), in which the electromagnetic radiation emitted from the antenna 100 is unilateral along the wave propagation axis, i.e. y-axis as shown in FIG. 1. In addition, the electromagnetic radiation only propagates in a unilateral direction rather than both directions along the y-axis. As appreciated by a person skilled in the art, this may further enhance the transmission efficiency of the electromagnetic wave from the antenna to a target EM wave receiver.

The dielectric resonator 102 may be provided as a rectangular block of dielectric material. The dielectric material has a dielectric constant among different material, therefore different dielectric materials may be used for fabricating the DR according to the desired parameters of the antenna. Alternatively, the dielectric resonator 102 may also be provided in different shape based on different requirements.

The rectangular DR 102 includes at least one planar surface which is rectangular or substantially rectangular in shape. Preferably, the ground plane 106 is positioned adjacent to the planar surface, and the ground plane 106 may also include a dimension substantially equal to the planar surface of the dielectric resonator, i.e. the shape and projection area being substantially the same. This may effectively reduce the size and the footprint of the DRA 100.

In addition, the antenna 100 also includes a feeder 104 such as a probe feeder. Referring to FIG. 1, the probe feeder 104 is positioned shifted from a center position (or a centroid) of the rectangular dielectric resonator 102, and the probe feeder 104 passes through the ground plane 106 and is disposed within a hole 102H in the dielectric resonator 102. For example, a drill hole may be provided in the DR block 102 such that when the ground plane 106 and the probe feeder 104 combines with the DR 102, the probe feeder 104 inserts into the drill hole and is embedded in the DR block 102.

In the example embodiment as shown in FIG. 1, in the example DRA 100, the DR 102 may be designed to include a dielectric constant of $\varepsilon_r$=10 and dimensions of $l_a$=43.6 mm, $l_b$=24.4 mm, and H=21.2 mm. It rests on a ground plane 106 that fits the cross section/projection of the DR 102, with a thickness of $G_h$=2 mm. To excite the $TE_{\delta 11}{}^x$ and $TE_{2\delta 1}{}^y$ modes simultaneously, a probe 104 with a diameter of d=1.27 mm and length of h=11.2 mm is located at a distance of $l_p$=4.7 mm from the center of the DR 102.

Alternatively, it should be appreciated that the antenna may be designed with different parameters such as dielectric constant, different shapes or and dimensions, a different feeder in a different position, and/or a different ground plane, based on requirements or desired performances achievable by adopting different designs.

Preferably, the result electromagnetic radiation emitted by the unilateral antenna may be a combination of a plurality of electromagnetic wave components, including a first electromagnetic wave component and a second electromagnetic wave component. For example, the first electromagnetic wave component may produce broadside radiation patterns and the second electromagnetic wave component may produce quasi-omnidirectional radiation patterns, such that when the first and the second electromagnetic wave components are combined, a complementary field pattern equivalent to a field pattern of the electromagnetic radiation may be formed.

More preferably, the first and the second electromagnetic wave components are respectively arranged in a first and a second direction, and each of the first and the second direction is orthogonal to the wave propagation axis. Optionally or additionally, the first (x-) direction, the second (z-) direction and the wave propagation (y-) axis are mutually orthogonal to each other.

In one example embodiment, with the wave propagation axis is defined along a y-axis of a three-dimensional space, the first electromagnetic wave component may be exited in a dielectric resonator $TE_{\delta 11}{}^{x}$ mode, which includes an O-shape field pattern and an ∞-shape field pattern in a yz-plane and a xy-plane respectively. On the other hand, the second electromagnetic wave component may be exited in a dielectric resonator $TE_{2\delta 1}{}^{y}$ mode, which includes an ∞-shape field pattern and an elliptical-shape ("0"-shape) field pattern in a yz-plane and a xy-plane respectively. The second electromagnetic wave component may have a stronger $H_y$ component than a $H_x$ component in the xy-plane, therefore it has an elliptical-shape field pattern in the xy-plane.

Alternatively or additionally, the target electromagnetic radiation may be formed by combined with other types and numbers of EM wave components or radiations.

A simulation of the DRA 100 in accordance with an embodiment of the present invention was carried out. In this example, the rectangular DRA resonates at 2.32 GHz and 2.51 GHz. The internal E- and H-fields of the first resonant mode (2.32 GHz) was studied first and it was found that the field distributions resemble those of the $TE_{\delta 11}{}^{x}$ mode. This mode may work like an equivalent x-directed magnetic dipole, having the figure-"O" and -"∞" far-field patterns in the yz- and xy-planes, respectively.

The second resonant mode (2.51 GHz) was studied next. It was found that when moving the probe 104 to the DR center, the resonant frequency shifts to 2.55 GHz due to the change of the probe loading.

Figures 2A, 2B:
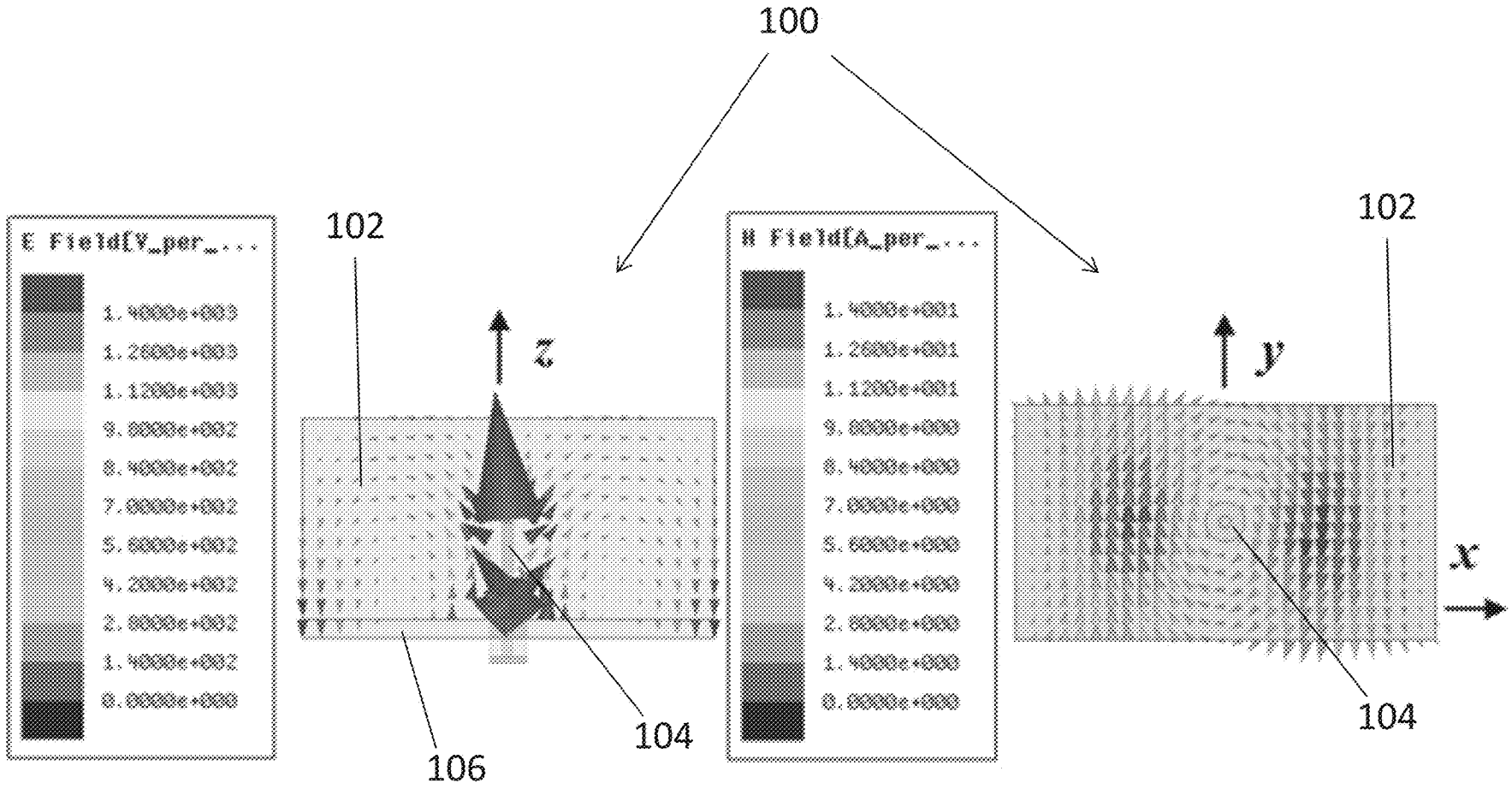
FIG. 2A is a plot showing a simulated E-field inside DRA of FIG. 1 at 2.55 GHz in xz-plane.
FIG. 2B is a plot showing a simulated H-field inside DRA of FIG. 1 at 2.55 GHz in xy-plane.

With reference to FIGS. 2A and 2B, there is shown the E- and H-fields inside the DRA 100 at 2.55 GHz. Referring to FIG. 2A, the E-field has two half circles along the x-axis, one on the left and the other one on the right. Referring to FIG. 2B, there are two strong H-field components ($H_y$) near $x=\pm l_a/4$ with opposite directions. The field distributions are consistent with those of the $TE_{2\delta 1}{}^{y}$ mode. Using a dielectric waveguide model (DWM), the predicted frequency is 2.67 GHz, which is higher than the simulated value by 4.5%. The deviation may be caused by the fact that the DWM method assumes an infinite ground plane size whereas a smaller ground plane 106 is included in the embodiments of the present invention.

The $TE_{2\delta 1}{}^{y}$ mode may be modelled as two equivalent horizontal magnetic dipoles. With reference to FIG. 2B, the H-field of the $TE_{2\delta 1}{}^{y}$ mode has an $H_x$ component that causes the H-field to form a closed loop in the xy-plane. Thus, this mode can somehow be regarded as a quasi-vertical electric dipole as the E-field has the figure-∞ pattern in the elevation plane (as shown in FIG. 2A) whereas the H-field somewhat has the figure-O pattern in the azimuthal plane (referring to FIG. 2B).

The $TE_{2\delta 1}{}^{y}$ mode of a rectangular DR can be analyzed with the dielectric waveguide model (DWM). This model is based on a Marcatili's approximation that assumes an infinitely large ground plane. Using this model, the wave numbers $k_x$, $k_y$, $k_z$ can be obtained as follows:

$$k_x l_a = 2\pi - 2\tan^{-1}\left(k_x \Big/ \left(\varepsilon_r\sqrt{(\varepsilon_r - 1)k_0^2 - k_x^2}\right)\right)$$

$$k_y l_a = \pi - 2\tan^{-1}\left(k_y \Big/ \sqrt{(\varepsilon_r - 1)k_0^2 - k_y^2}\right)$$

$$k_z H = \pi/2 - \tan^{-1}\left(k_z \Big/ \left(\varepsilon_r\sqrt{(\varepsilon_r - 1)k_0^2 - k_z^2}\right)\right)$$

$$\varepsilon_r k_0^2 = k_x^2 + k_y^2 + k_z^2$$

where $\in_r$ and $k_0$ are the dielectric constant and free-space wavenumber, respectively, and the internal E- and H-fields can then be written as:

$$E_x = Ak_z \sin(k_x x)\cos(k_y y)\sin(k_z z)$$

$$E_y = 0$$

$$E_z = Ak_x \cos(k_x x)\cos(k_y y)\cos(k_z z)$$

$$H_x = A\frac{k_x k_y}{j\omega\mu_0}\cos(k_x x)\sin(k_y y)\cos(k_z z)$$

$$H_y = -A\frac{k_x^2 + k_z^2}{j\omega\mu_0}\sin(k_x x)\cos(k_y y)\cos(k_z z)$$

$$H_z = -A\frac{k_x k_y}{j\omega\mu_0}\sin(k_x x)\sin(k_y y)\sin(k_z z)$$

Figure 3B:
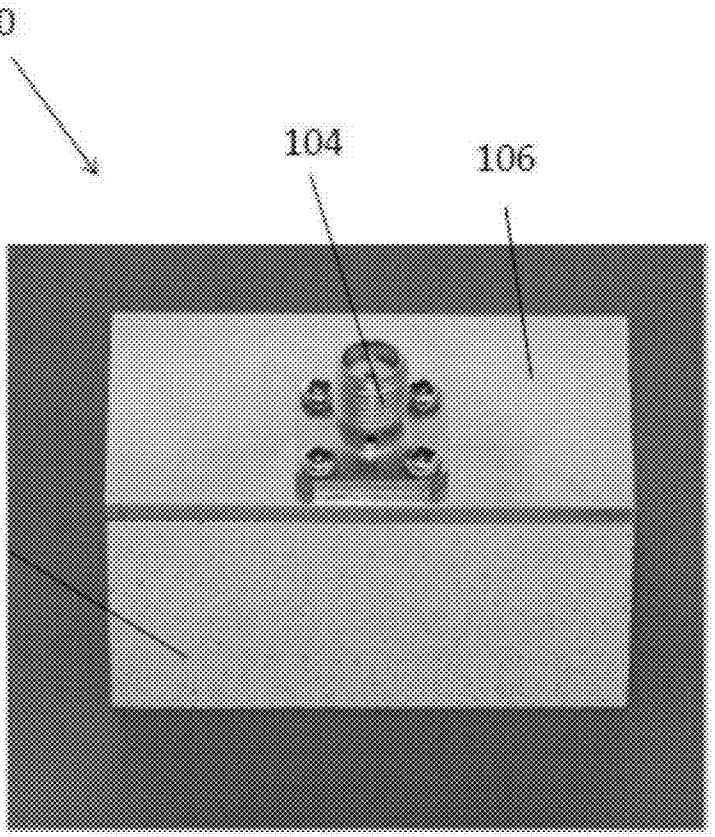
FIG. 3B is a photographic image showing a bottom view of the unilateral antenna of FIG. 3A.
Figure 3A:
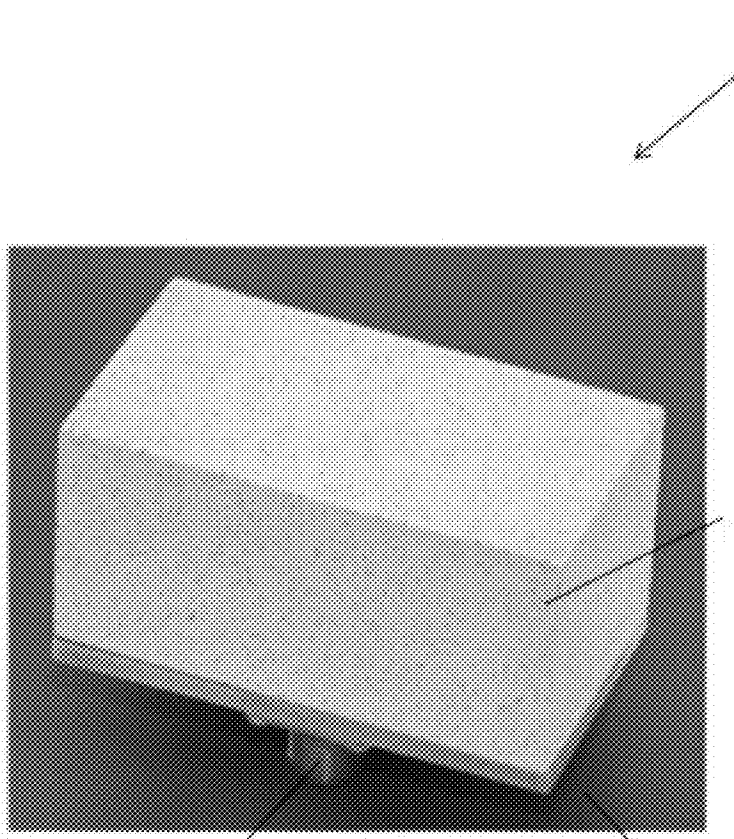
FIG. 3A is a photographic image showing a perspective view of the unilateral antenna of FIG. 1.

With reference to FIGS. 3A and 3B, there is shown a fabricated antenna 100 in accordance with an embodiment of the present invention. To suppress the return current on the outer conductor of the coaxial cable, an RF choke may be used in the measurement.

Figure 4:
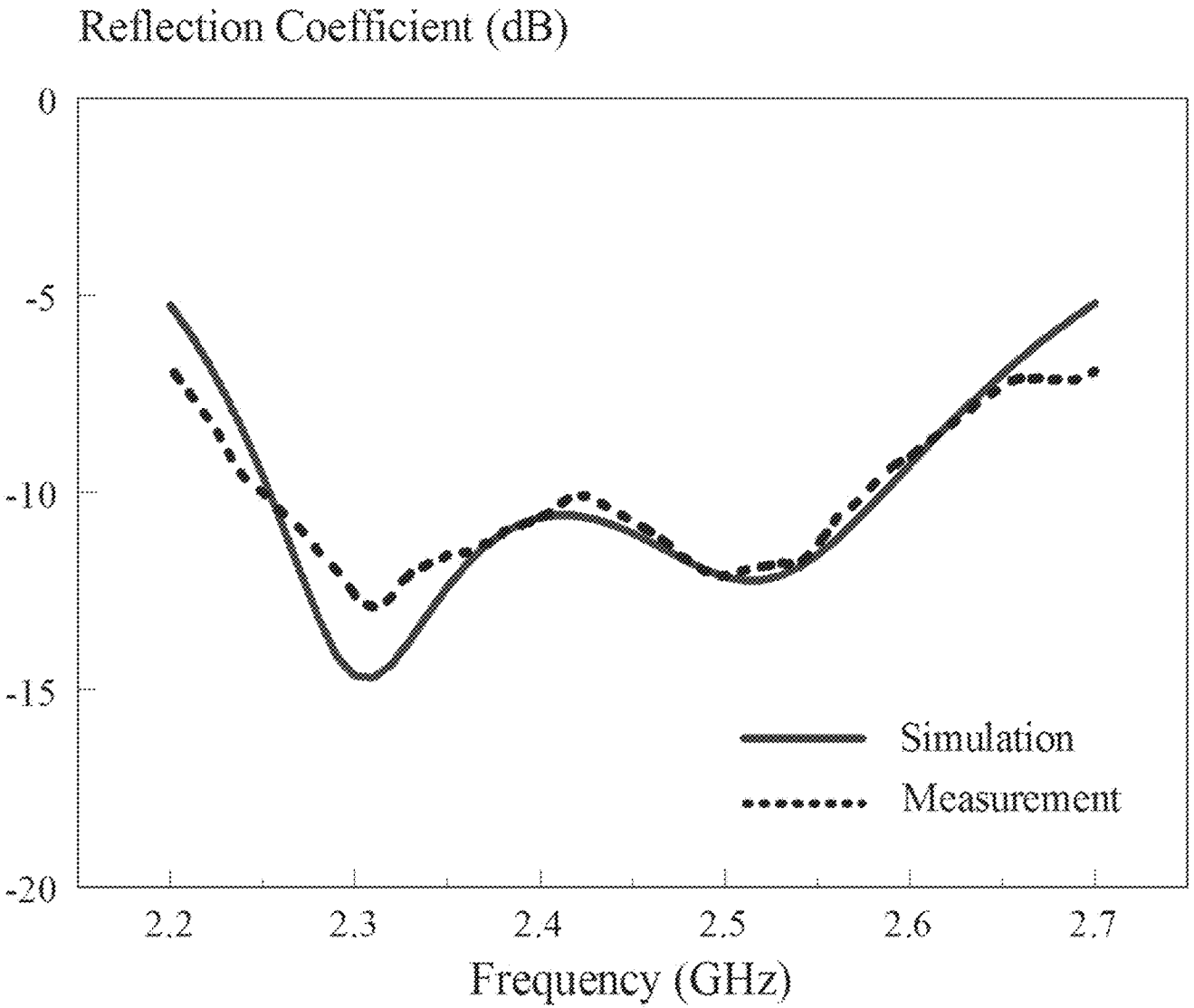
FIG. 4 is a plot showing measured and simulated reflection coefficients of unilateral DRA of FIG. 1.

With reference to FIG. 4, there is shown the measured and simulated reflection coefficients which agree reasonably well with each other. Both the measured and simulated frequencies of the $TE_{\delta 11}{}^{x}$ mode are 2.31 GHz. For the $TE_{2\delta 1}{}^{y}$ mode, the measured and simulated frequencies are found at 2.51 GHz and 2.50 GHz, respectively. Both the measured and simulated impedance bandwidths ($|S_{11}| \leq 10$ dB) of the antenna are equal to 13.2% (2.26-2.58 GHz).

Figures 5A, 5B:
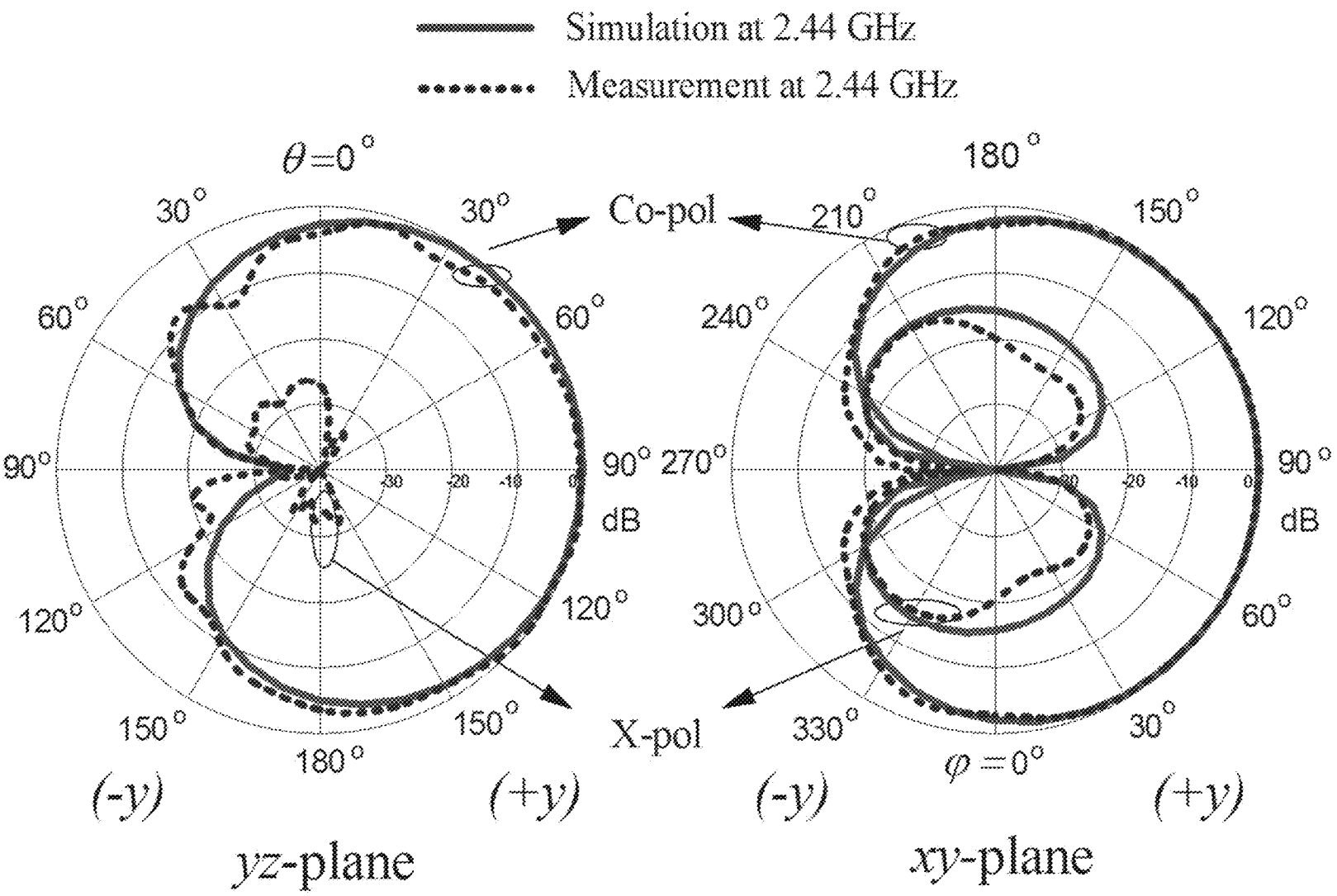
FIGS. 5A and 5B are plots showing measured and simulated radiation patterns of unilateral DRA of FIG. 1 at 2.44 GHz.

With reference to FIG. 5, there is shown the measured and simulated radiation patterns at 2.44 GHz, which is roughly the center frequency between the $TE_{\delta 11}{}^{x}$ and $TE_{2\delta 1}{}^{y}$ modes. It may be observed that the unilateral antenna operates with very low back radiation.

A reasonable agreement between the measured and simulated results is obtained. The measured and simulated FTBRs are given by as high as 36.6 dB and 35.1 dB, respectively. For the yz- and xy-plane 3-dB beamwidths, the measured values are given by 174° and 196°, and the corresponding simulated results are 172° and 196°, respectively. These beamwidths are much wider than those of the some example unilateral DRA designs. The results of the FTBRs and beamwidths are summarized as below.

| | Measurement | | | Simulation | | |
|---|---|---|---|---|---|---|
| | | Beamwidth (degree) | | | Beamwidth (degree) | |
| Freq. (GHz) | FTBR (dB) | yz-plane | xy-plane | FTBR (dB) | yz-plane | xy plane |
| 2.40 | 16.8 | 174 | 177 | 15.0 | 168 | 198 |
| 2.44 | 36.6 | 174 | 196 | 35.1 | 172 | 196 |
| 2.48 | 15.6 | 152 | 224 | 15.0 | 150 | 232 |

It was found that the measured bandwidth for FTBR>15 dB and $|S_{11}|\leq 10$ dB is ~4%, which is the usable bandwidth of the antenna. With reference to the above table, the measured 3-dB xy-plane beamwidths are at least 177°, which is much larger than that (131°) obtained by using the obliquity factor (1+sin $\chi$) for a x-directed magnetic dipole combined with a z-directed electric dipole in another example. The much wider beamwidth of the DRA of the present invention is due to the characteristics of DR $TE_{2\delta 1}^{y}$ mode as discussed earlier.

Figure 6:
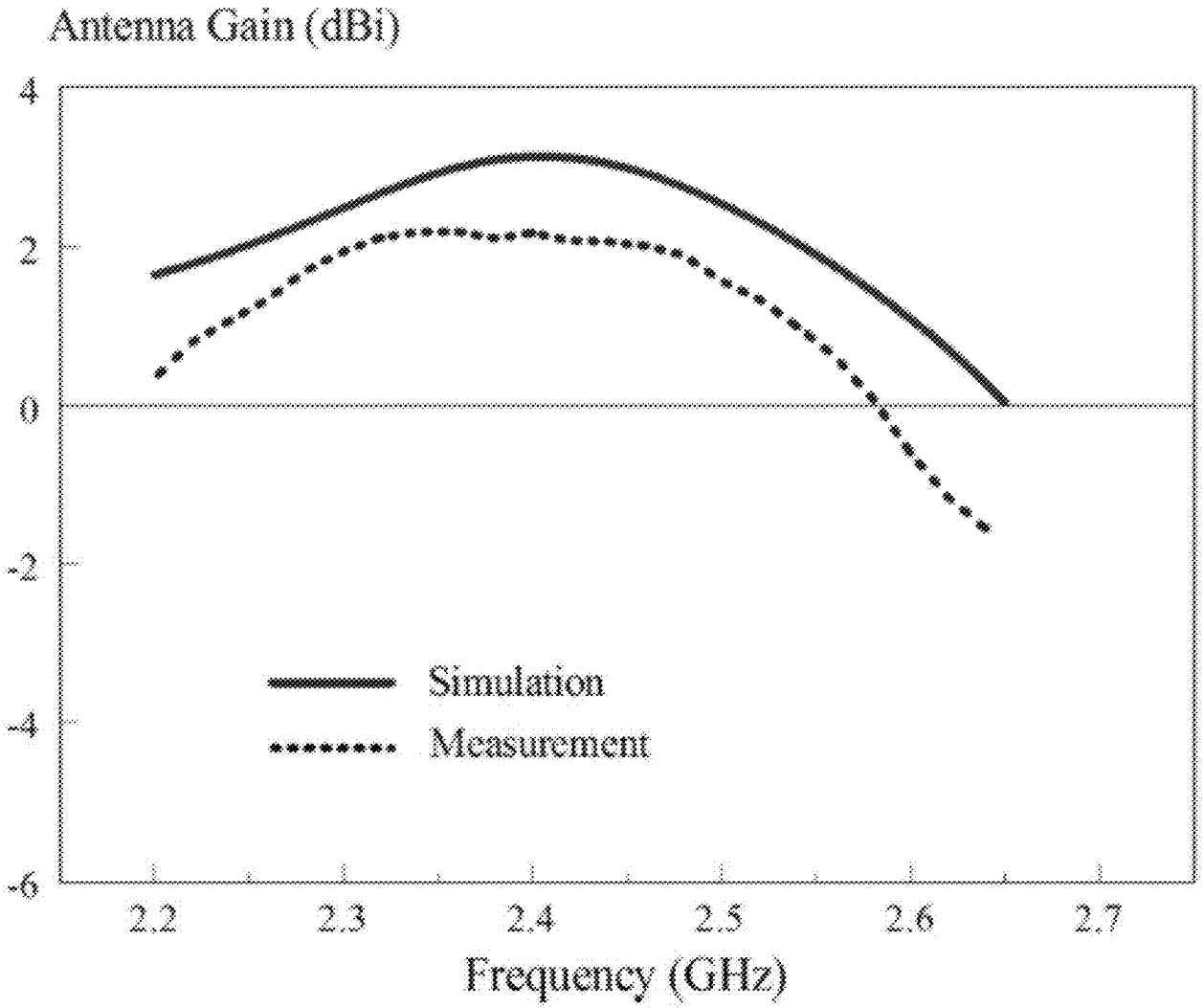
FIG. 6 is a plot showing measured and simulated antenna gains of unilateral DRA of FIG. 1.

With reference to FIG. 6, there is shown the measured and simulated antenna gains of the unilateral DRA at $\theta$=90°, $\varphi$=90°. Again, a reasonable agreement between the measured and simulated results can be observed. With reference to the figure, the maximum measured and simulated antenna gains are 2.2 dBi and 3.1 dBi at 2.4 GHz, respectively. It can be observed from the figure that the measured gain is lower than the simulated result, which is expected due to experimental imperfections. Across the usable bandwidth, the measured antenna gain is more than 1.9 dBi.

Figure 7:
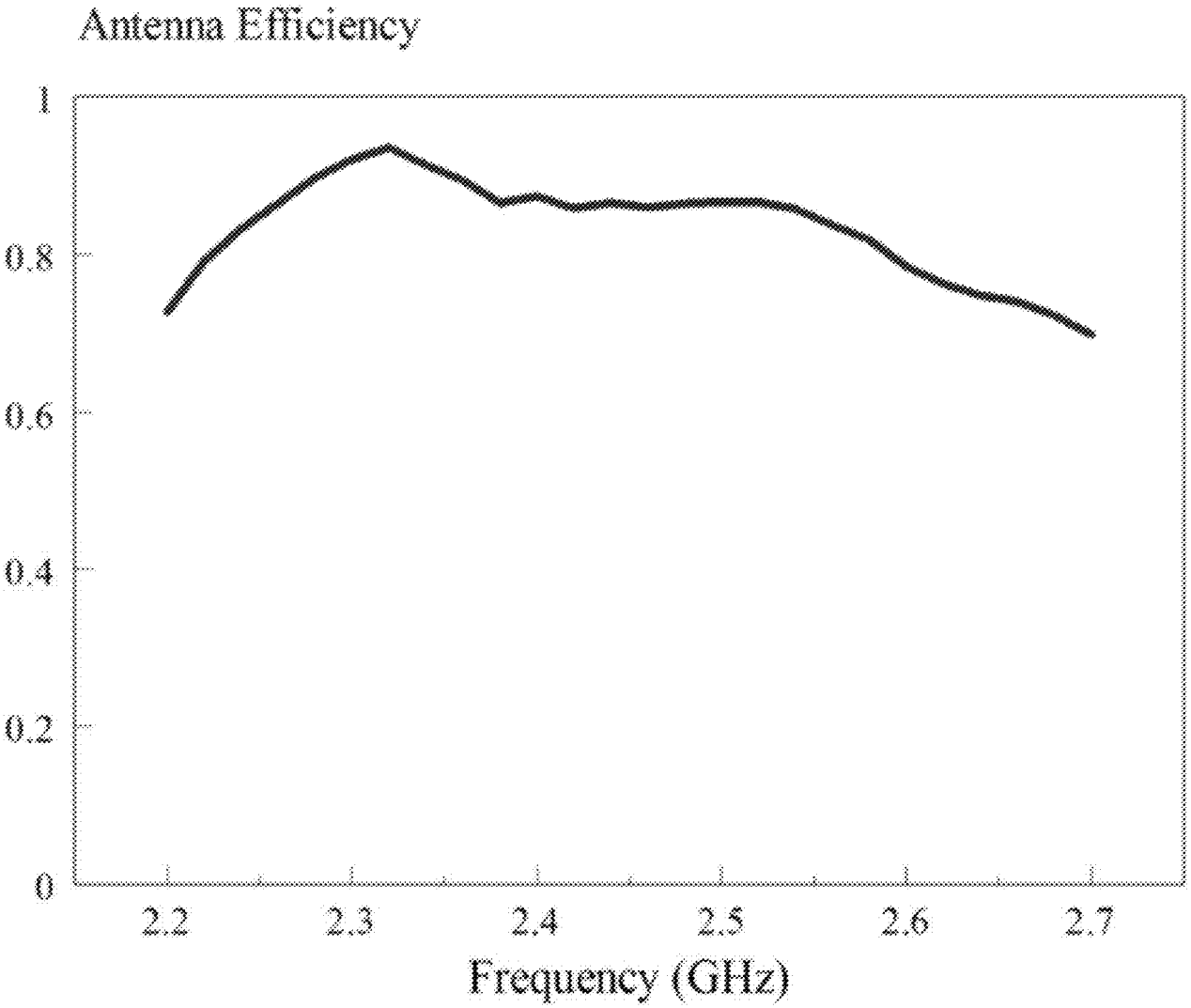
FIG. 7 is a plot showing measured antenna efficiency of unilateral DRA of FIG. 1.

With reference to FIG. 7, there is shown the measured total antenna efficiency that has included impedance mismatch. As seen from the figure, the efficiency is higher than 86.0% across the usable frequency band, with a peak value of 87.3% at 2.4 GHz. Both the antenna gain and total efficiency are comparable to other unilateral DRAs as compared.

Figure 8:
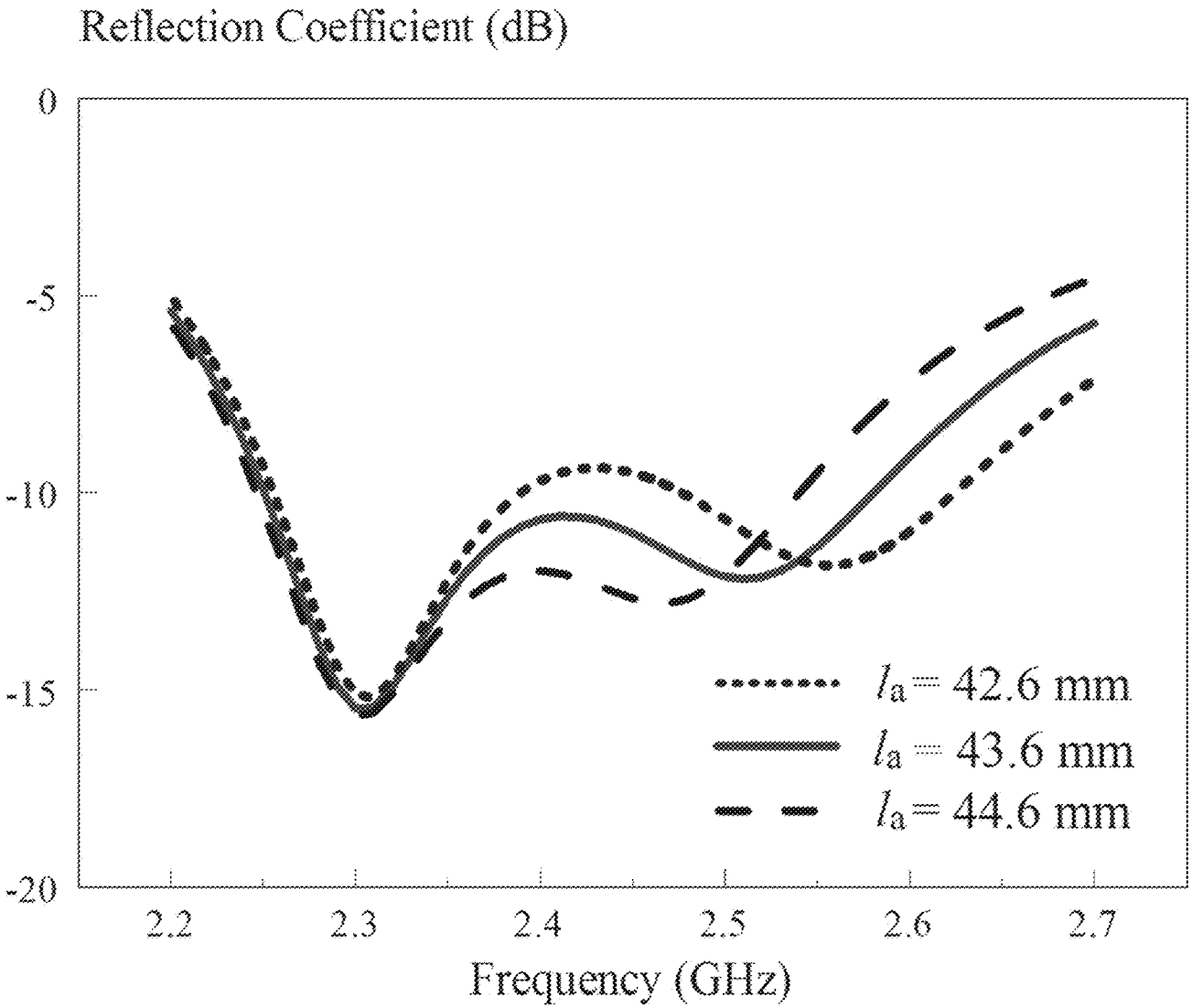
FIG. 8 is a plot showing simulated reflection coefficients of unilateral DRA of FIG. 1 with different DR lengths of $l_a$=42.6 mm, 43.6 mm, and 44.6 mm.

The inventors also conducted a parametric study conducted to investigate the effects of the various parameters of the DRA according to embodiments of the present invention. For example, the length $l_a$ of the DRA is analysed, referring to FIG. 8, there is shown the simulated reflection coefficient for $l_a$=42.6 mm, 43.6 mm, and 44.6 mm. The second mode ($TE_{2\delta 1}^{y}$ mode) shows a notable frequency shift, while the first mode ($TE_{\delta 11}^{x}$ mode) remains unchanged. The study presents the strong effect of $l_a$ on the second mode ($TE_{2\delta 1}^{y}$ mode) rather than the first mode ($TE_{\delta 11}^{x}$ mode).

Figure 9:
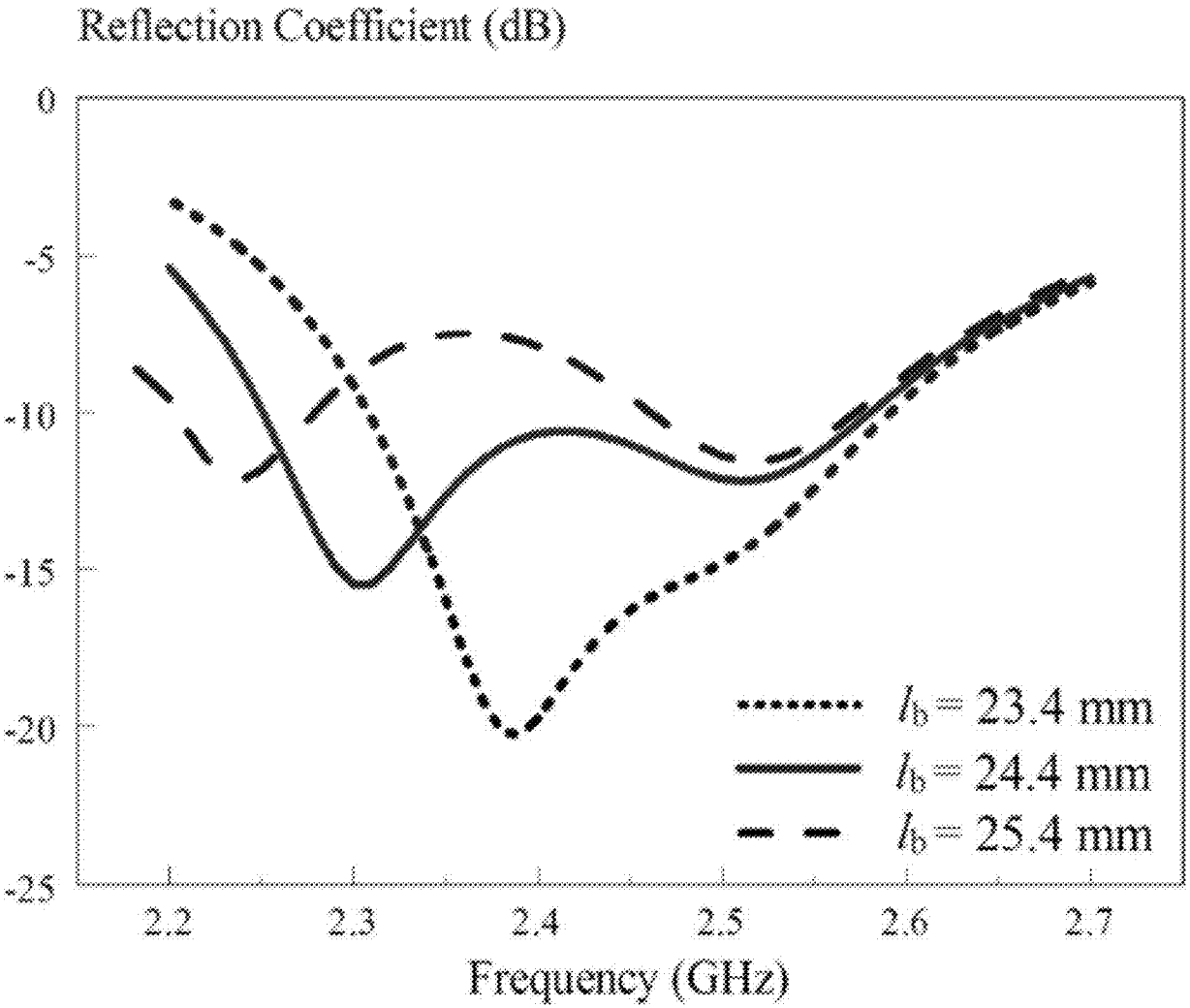
FIG. 9 is a plot showing simulated reflection coefficients of unilateral DRA of FIG. 1 with different DR lengths of $l_b$=23.4 mm, 24.4 mm, and 25.4 mm

In another example, with reference to FIG. 9, the DR length $l_b$ is varied from 23.4 mm to 25.4 mm, with a step of 1 mm, and the corresponding simulated reflection coefficients are shown in the Figure. An obvious frequency shift is found for the first mode ($TE_{\delta 11}^{x}$ mode), but the second mode ($TE_{2\delta 1}^{y}$ mode) moves little. It demonstrates that the first mode ($TE_{\delta 11}^{x}$ mode) is very sensitive to $l_b$, while the second mode ($TE_{2\delta 1}^{y}$ mode) is insensitive. Besides, the DR height H is also varied, and the result is not shown here for brevity. As expected, both mode frequencies reduce as the increase of H.

Preferably, the design may be further simplified as the parametric studies above suggest that the two DR modes can be tuned separately by changing different DR lengths, if the DR height is fixed.

Figure 10:
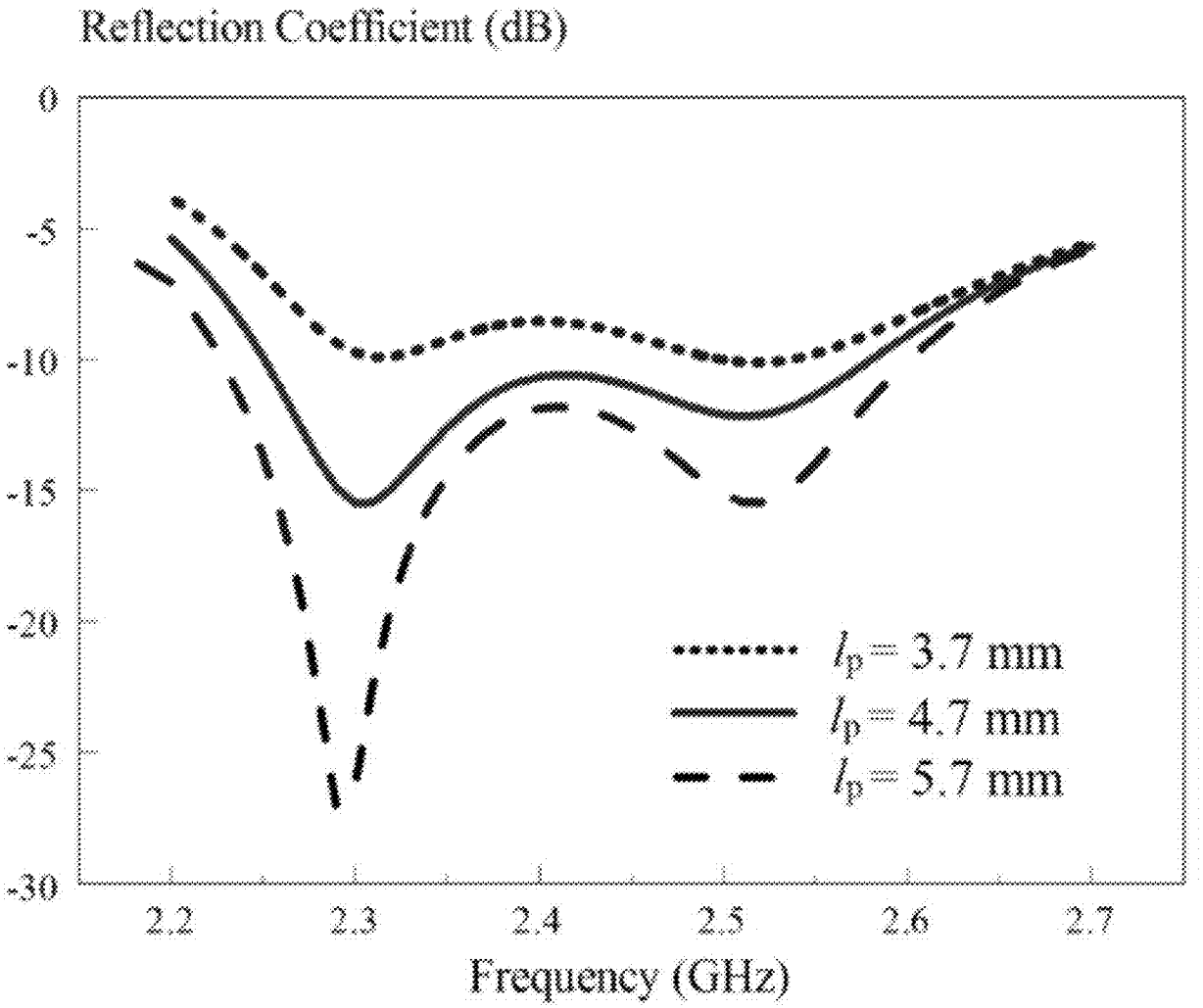
FIG. 10 is a plot showing simulated reflection coefficients of unilateral DRA of FIG. 1 with different probe positions of $l_p$=3.7 mm, 4.7 mm, and 5.7 mm.

Furthermore, with reference to FIG. 10, the probe position $l_p$ was investigated by varying from 3.7 mm to 5.7 mm with a step of 1 mm. No obvious frequency shift was found for each mode, except the matching levels. It means that the probe position $l_p$ can be used to get a good impedance matching after DR dimension is fixed. Besides, it is also found that the probe position $l_p$ plays an important part in FTBR.

Figure 11:
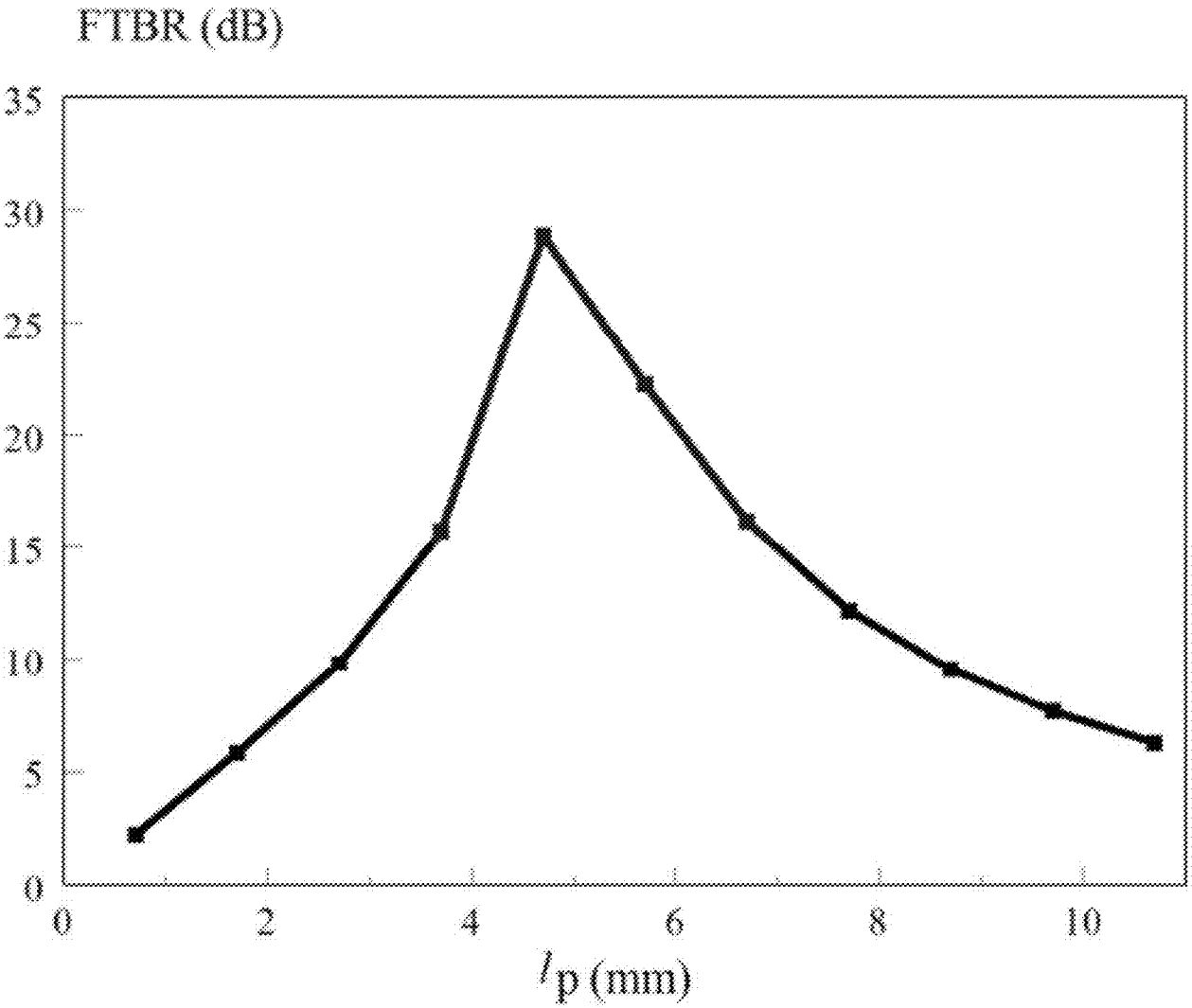
FIG. 11 is a plot showing simulated FTBRs of unilateral DRA of FIG. 1 against different probe positions $l_p$.

With reference to FIG. 11, there is shown the FTBR against probe position $l_p$ at 2.44 GHz. As can be observed the FTBR reaches the highest point of 29 dB at $l_p$=4.7 mm. In one preferable embodiment, the best impedance matching is obtained at $l_p$=5.7 mm in the three cases as shown in FIG. 10, but the FTBR is only 22 dB. For a compromise between the impedance matching and FTBR, the value of $l_p$=4.7 mm is chosen in the design.

Using the parametric study results, a brief design guideline can be devised as follows. The DR dimensions are first determined according to the two DR modes at the given frequency band. Then the probe position can be adjusted to tune the impedance matching and FTBR. Finally, all structural parameters can be adjusted together in order to get the optimized results.

The above embodiments may be advantageous in that the present invention provides a novel dielectric resonator antenna design, which may be used to transmit wireless signal in a unilateral direction by simultaneously exciting the antenna using the fundamental mode as well as the higher-order modes.

Advantageously, a unilateral DRA may be designed, fabricated, and measured in accordance with the preferable embodiments as discussed. The DRA uses two DR modes excited by an off-center located probe, showing a simple structure. The ground plane is as small as the DR dimension, which gives a compact antenna size.

The feeding probe simultaneously excites the adjacent $TE_{\delta 11}^{x}$ and $TE_{2\delta 1}^{y}$ modes of the DR, generating broadside and quasi-omnidirectional radiation patterns. By combining the field patterns of the two modes, a y-directed unilateral radiation can be obtained.

It is also proved that the antenna may operate with a high performance. The FTBR is higher than 15 dB over the 2.4-GHz WLAN band, with the maximum value of 36.6 dB at 2.44 GHz. The measured half-power beamwidths are broader than 152° for both yz- and xy-planes over the WLAN band.

In addition, the unilateral DRA has measured impedance and FTBR bandwidths of 13.2% (2.26-2.58 GHz) and ~4% (2.39-2.49 GHz), respectively, giving a usable bandwidth of ~4%. Over the usable frequency band, it has a maximum FTBR of 36.6 dB and widest 3-dB beamwidth of 174°. Compared with previous unilateral DRA designs, the 3-dB beamwidth is larger by −40°. Besides, the maximum antenna gain and total antenna efficiency are 2.2 dBi and 87.3%, respectively, which are both comparable with those unilateral DRA designs.

The antenna may be fine-tuned easily. Parametric studies were also carried out to investigate the relationship between the structural parameters and antenna performance. It was found the DR length $l_a$ and $l_b$ control high-order $TE_{2\delta 1}^{y}$ mode and fundamental $TE_{\delta 11}^{x}$ mode, respectively, after the DR height is fixed. The probe location of $l_p$ can be adjusted to tune the impedance matching and FTBR.

The DRA also shows a very wide 3-dB beamwidth exceeding 177° in the azimuthal plane, which further suggest that the DRA may be applied in base station applications that prefers the wide beamwidth in the azimuthal plane.

For example, the base station may be deployed with an antenna array which comprises a plurality of antenna in the previous discussed embodiments. Each of the wave propagation axes of the respective antenna includes an orientation different from each other, or at least two of the wave propagation axes of the respective antenna are oriented in parallel, such that the coverage of the base station may be optimized based on the complexity of the terrain.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A unilateral antenna comprising a dielectric resonator fed by an off-center probe feeder connected to a ground plane, wherein the probe feeder passes through the ground plane and is disposed within a hole in the dielectric resonator such that the probe feeder inserts into the hole and is embedded in the dielectric resonator;

wherein the probe feeder is positioned shifted from a center position of the dielectric resonator; and wherein the probe feeder is arranged to simultaneously excite the dielectric resonator in at least a first dielectric resonator mode and a second dielectric resonator mode, such that the dielectric resonator is further arranged to emit an electromagnetic radiation unilaterally along a wave propagation axis upon an electric excitation input to the probe feeder, wherein the electromagnetic radiation is equivalent to a combination of a plurality of electromagnetic wave components including a first electromagnetic wave component being equivalent to an x-directed magnetic dipole and a second electromagnetic wave component being equivalent to a z-directed electric dipole, and wherein the first and the second electromagnetic wave components are respectively arranged in a first and a second direction along an x-axis and a z-axis respectively, and wherein each of the first and the second direction is orthogonal to the wave propagation axis along ay-axis of a three-dimensional space.

2. The unilateral antenna in accordance with claim 1, wherein the-ground plane is perpendicular to the z-axis.

3. The unilateral antenna in accordance with claim 1, wherein the first electromagnetic wave component is arranged to produce a broadside radiation pattern in the first direction.

4. The unilateral antenna in accordance with claim 3, wherein the second electromagnetic wave component is arranged to produce a quasi-omnidirectional radiation pattern in a second direction.

5. The unilateral antenna in accordance with claim 4, wherein the first and the second electromagnetic wave components combine and form a complementary field pattern equivalent to a field pattern of the electromagnetic radiation.

6. The unilateral antenna in accordance with claim 5, wherein the first electromagnetic wave component is exited in a fundamental mode of the dielectric resonator.

7. The unilateral antenna in accordance with claim 6, wherein the second electromagnetic wave component is exited in a higher-order mode of the dielectric resonator.

8. The unilateral antenna in accordance with claim 4, wherein the first electromagnetic wave component includes an O-shape field pattern and an ∞-shape field pattern in a yz-plane and a xy-plane respectively.

9. The unilateral antenna in accordance with claim 8, wherein the second electromagnetic wave component includes an ∞-shape field pattern and an elliptical-shape field pattern in a yz-plane and a xy-plane respectively.

10. The unilateral antenna in accordance with claim 9, wherein the second electromagnetic wave component includes a stronger $H_y$ component than a $H_x$ component in the xy-plane.

11. The unilateral antenna in accordance with claim 1, wherein the probe feeder is positioned through the ground plane and is disposed within a hole in the dielectric resonator.

12. The unilateral antenna in accordance with claim 1, wherein the ground plane includes a dimension substantially equal to a planar surface of the dielectric resonator.

13. The unilateral antenna in accordance with claim 12, wherein the ground plane is positioned adjacent to the planar surface.

14. The unilateral antenna in accordance with claim 12, wherein planar surface is substantially rectangular in shape.

15. The unilateral antenna in accordance with claim 1, wherein the dielectric resonator is a rectangular block of dielectric material.

16. An antenna array comprising a plurality of antenna in accordance with claim 1.

17. The antenna array in accordance with claim 16, wherein each of the wave propagation axes of the respective antenna includes an orientation different from each other.

18. The antenna array in accordance with claim 16, wherein at least two of the wave propagation axis of the respective antenna are oriented in parallel.

* * * * *